US005678896A

United States Patent [19]

Chung

[11] Patent Number: 5,678,896

[45] Date of Patent: Oct. 21, 1997

[54] ARMREST ADJUSTING DEVICE

[76] Inventor: Peter Chung, No. 10, Lane 10, Tienpao St., Hsitun Dist., Taichung, Taiwan

[21] Appl. No.: 697,498

[22] Filed: Aug. 26, 1996

[51] Int. Cl.[6] ..... A47C 7/54

[52] U.S. Cl. ..... 297/411.38; 297/411.33; 297/411.32; 248/284.1

[58] Field of Search ..... 297/411.32, 411.33, 297/411.38; 248/284.1

[56] References Cited

U.S. PATENT DOCUMENTS

| | | | |
|---|---|---|---|
| 3,041,034 | 6/1962 | Wilkinson | 248/284.1 |
| 4,097,088 | 6/1978 | Meiller | 297/411.35 |
| 4,828,323 | 5/1989 | Broderson et al. | 297/411.33 |
| 5,029,941 | 7/1991 | Twisselmann | 297/411.38 |
| 5,143,422 | 9/1992 | Athofer et al. | 297/411.38 |
| 5,207,791 | 5/1993 | Scherbarth | 248/284.1 |
| 5,275,465 | 1/1994 | Gulliver et al. | 297/411.32 |
| 5,476,304 | 12/1995 | Gulliver et al. | 297/411.33 |

*Primary Examiner*—Peter M. Cuomo
*Assistant Examiner*—Anthony D. Barfield
*Attorney, Agent, or Firm*—Staas & Halsey

[57] ABSTRACT

An armrest adjusting device includes an L-shaped base having a horizontal section fixedly attached to each of two sides of a seat of a chair and a vertical section. A cover has a lower portion pivotally mounted on the vertical section of the base. A supporting plate is pivotally mounted on an upper portion of the cover. An armrest is fixedly mounted on an upper portion of the supporting plate. A first snapping mechanism is mounted on the upper portion of the cover and is detachably engaged with the supporting plate, for limiting a pivotal movement of the supporting plate relative to the upper portion of the cover. A second snapping mechanism is mounted on the lower portion of the cover and is detachably engaged with the vertical section of the base, for limiting a pivotal movement of the lower portion of the cover relative to the vertical section of the base.

4 Claims, 5 Drawing Sheets

ARMREST ADJUSTING DEVICE

FIELD OF THE INVENTION

The present invention relates to an armrest adjusting device, and more particularly to an adjusting device for an armrest of a chair.

BACKGROUND OF THE INVENTION

A conventional chair usually includes two armrests which are fixedly mounted on a seat such that the inclined angle and height of the armrests cannot be adjusted properly according to users of different stature, thereby greatly limiting the versatility of the armrests.

The present invention has arisen to mitigate and/or obviate the disadvantage of the conventional chair.

SUMMARY OF THE INVENTION

In accordance with one aspect of the present invention, there is provided an armrest adjusting device adapted to be suitable for a chair with a seat.

The armrest adjusting device includes a substantially L-shaped base having a horizontal section fixedly attached to each of two sides of the seat of the chair and a vertical section.

A cover has a lower portion pivotally mounted on the vertical section of the base. A supporting plate is pivotally mounted on an upper portion of the cover. An armrest is-fixedly mounted on an upper portion of the supporting plate.

A first snapping mechanism is mounted on the upper portion of the cover and is detachably engaged with the supporting plate for limiting a pivotal movement of the supporting plate relative to the upper portion of the cover.

A second snapping mechanism is mounted on the lower portion of the cover and is detachably engaged with the vertical section of the base for limiting a pivotal movement of the lower portion of the cover relative to the vertical section of the base.

Further features of the present invention will become apparent from a careful reading of the detailed description with reference to the accompanying drawings.

DETAILED DESCRIPTION OF THE PREFERRED EMBODIMENTS

Figure 1:
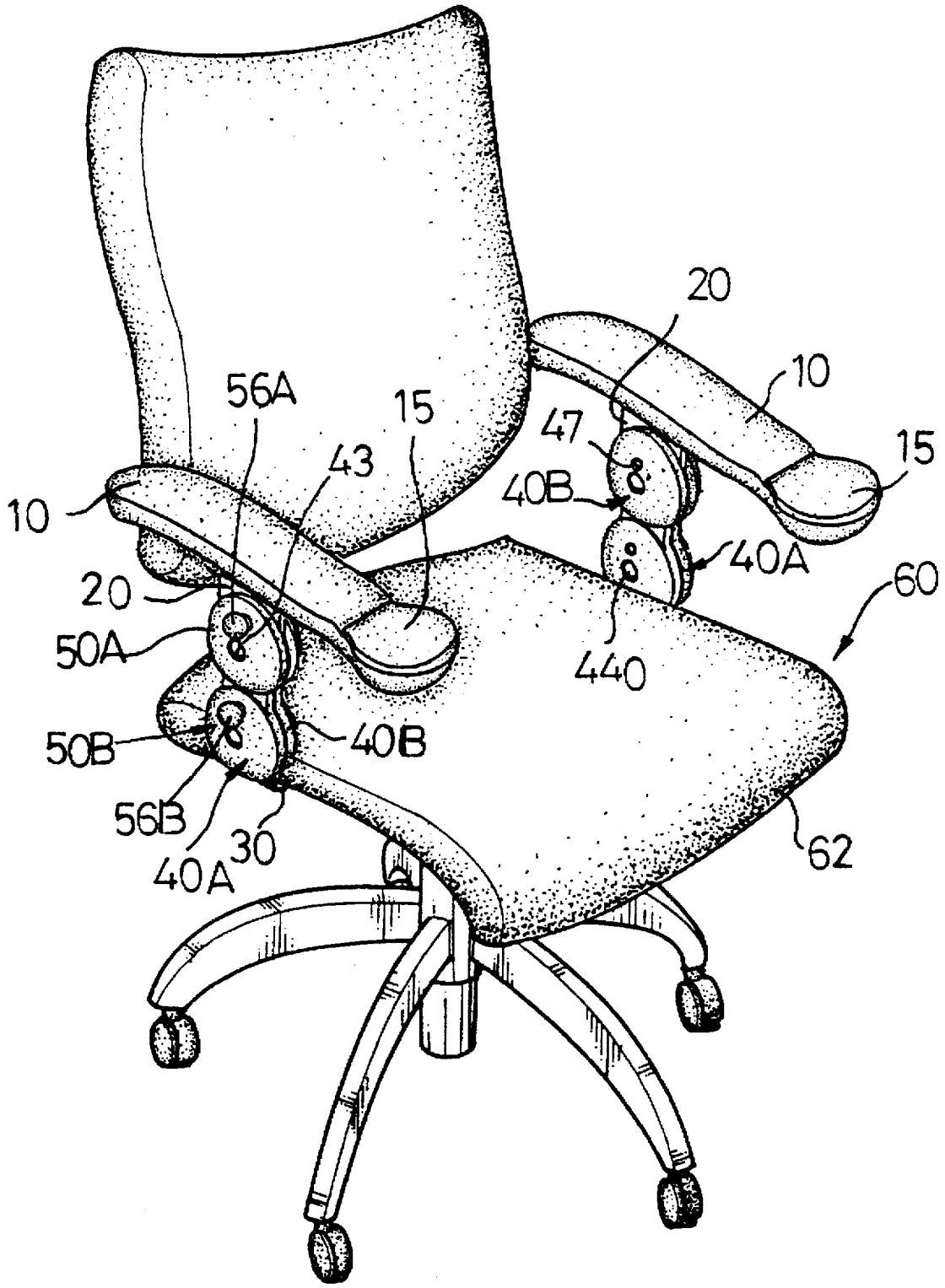
FIG. 1 is a perspective view of a chair according to an embodiment of the present invention.
Figure 2:
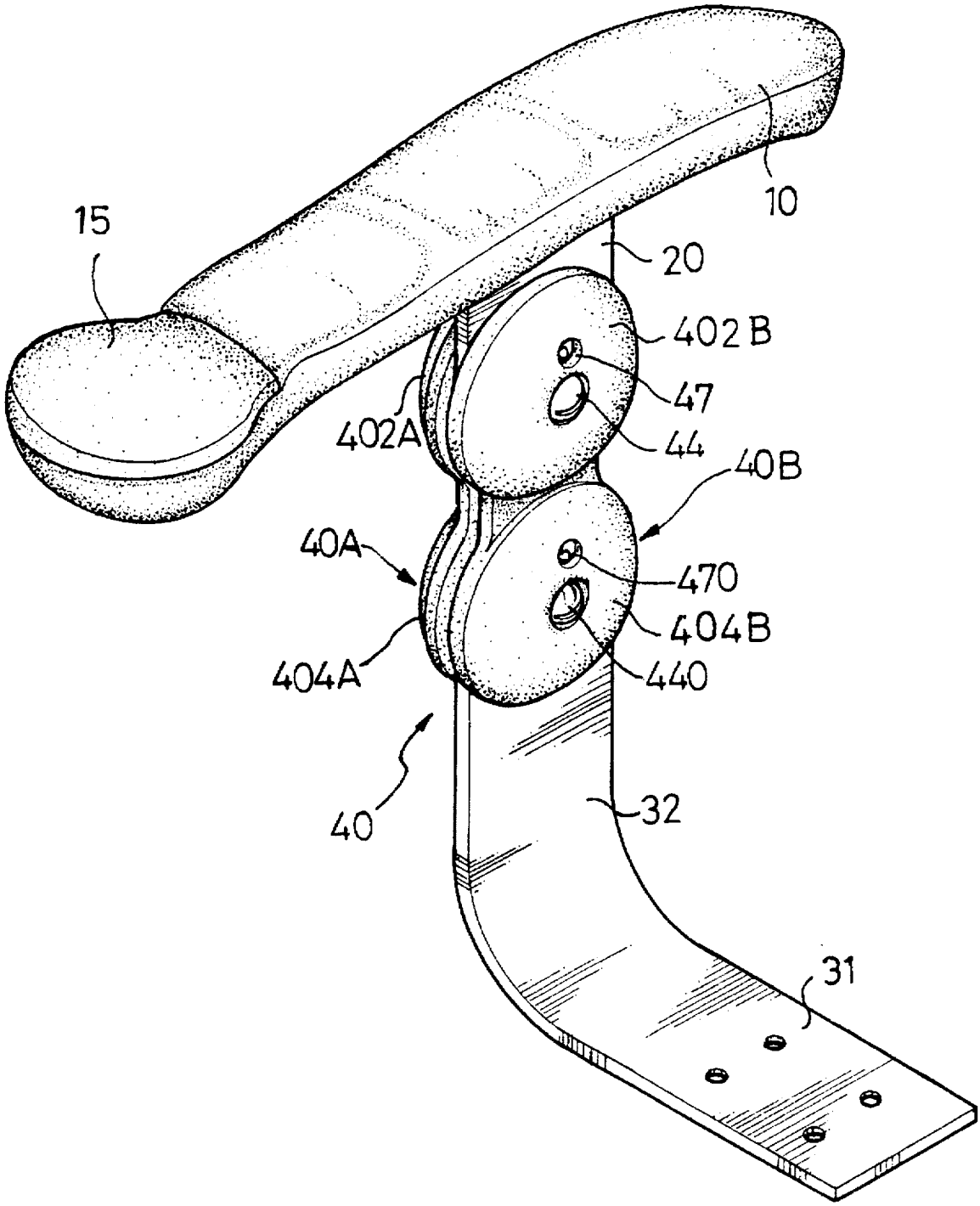
FIG. 2 is an enlarged perspective view of an armrest adjusting device in accordance with the embodiment of the present invention.
Figure 3:
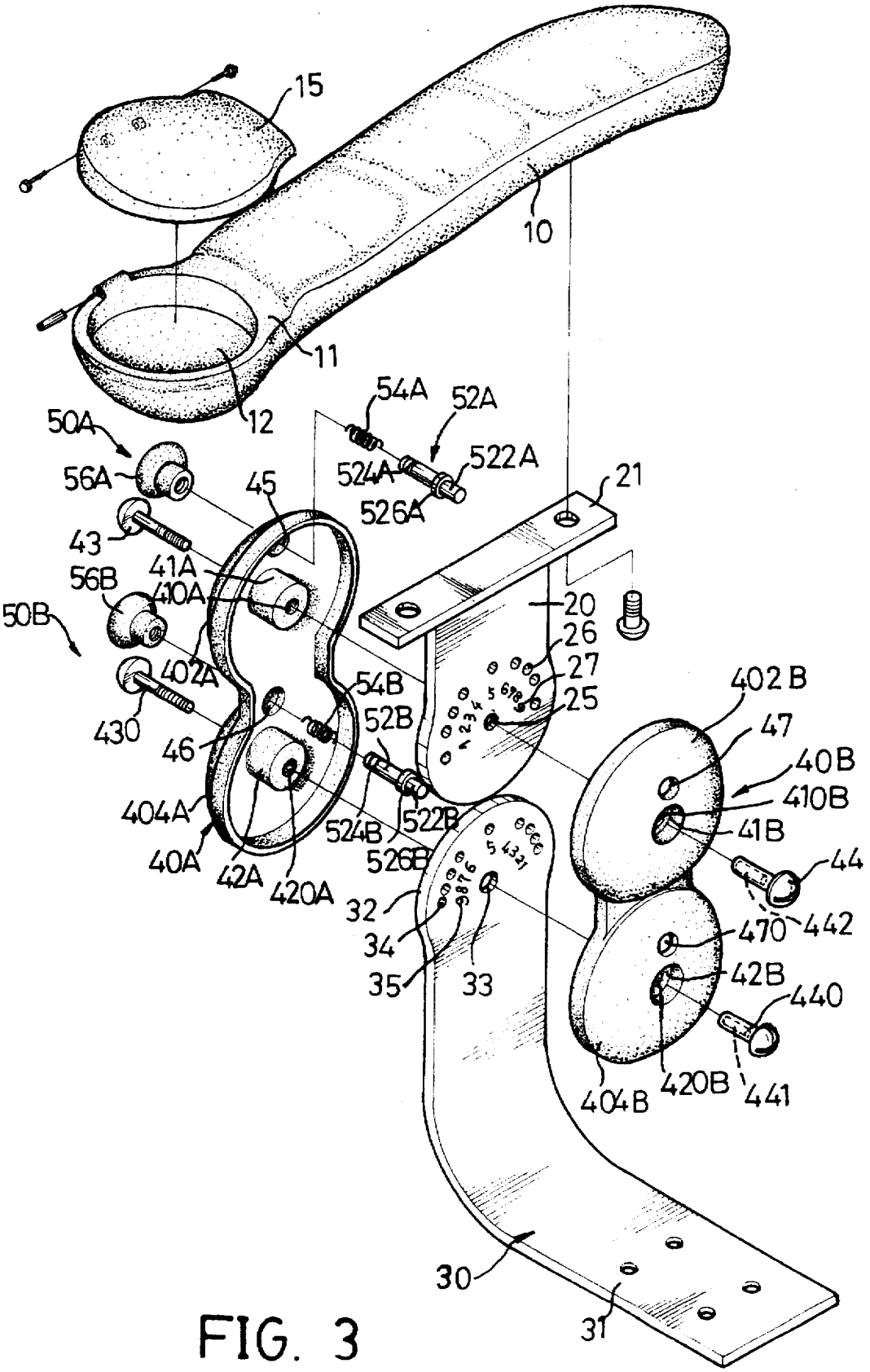
FIG. 3 is an exploded view of FIG. 2.
Figure 4:
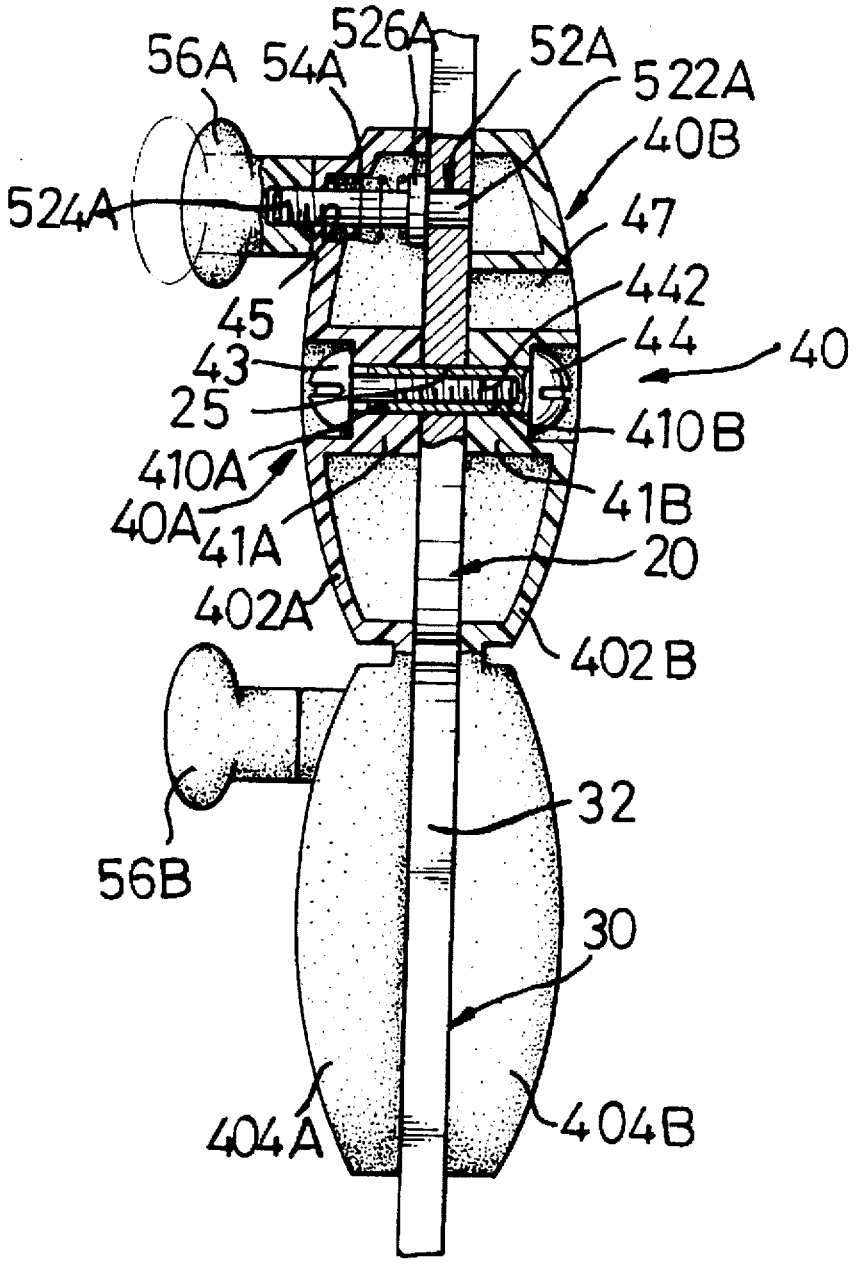
FIGS. 4 is a front plan partially cross-sectional view of FIG. 2.

Referring to the drawings, and initially to FIGS. 3 and 4 with reference to FIGS. 1 and 2, an armrest adjusting device in accordance with the present invention is adapted to be suitable for a chair 60 with a seat 62.

The armrest adjusting device comprises a substantially L-shaped base 30 having a horizontal section 31 fixedly attached to an underside of each of two sides of the seat 62 of the chair 60 and a vertical section 32.

A cover 40 has a lower portion pivotally mounted on the vertical section 32 of the base 30. A supporting plate 20 is pivotally mounted on an upper portion of the cover 40.

An armrest 10 is fixedly mounted on a horizontal plate 21 which is mounted on an upper portion of the supporting plate 20. The armrest 10 includes a steplike end portion 11 with a recess 12 defined therein. A cap 15 is pivotally mounted on the steplike end portion 11 of the armrest 10 for enclosing the recess 12.

A first snapping mechanism 50A is mounted on the upper portion of the cover 40 and is detachably engaged with the supporting plate 20 for limiting a pivotal movement of the supporting plate 20 relative to the upper portion of the cover 40.

A second snapping mechanism 50B is mounted on the lower portion of the cover 40 and is detachably engaged with the vertical section 32 of the base 30 for limiting a pivotal movement of the lower portion of the cover 40 relative to the vertical section 32 of the base 30.

Preferably, the cover 40 includes a first casing 40A having an upper portion 402A mounted on a first side of the supporting plate 20 and a lower portion 404A mounted on a first side of the vertical section 32 of the base 30, and a second casing 40B having an upper portion 402B mounted on a second side of the supporting plate 20 and a lower portion 404B mounted on a second side of the vertical section 32 of the base 30.

The supporting plate 20 has a center hole 25 defined therein. A first stub 41A extends from an inner wall of the upper portion 402A of the first casing 40A and abuts on the first side of the supporting plate 20. A first bore 410A is defined in the first stub 41A and aligns with the center hole 25.

A second stub 41B extends from an inner wall of the upper portion 402B of the second casing 40B and abuts on the second side of the supporting plate 20. A second bore 410B is defined in the second stub 41B and aligns with the center hole 25.

A first sleeve 44 is mounted in the upper portion 402B of the second casing 40B and extends through the second bore 410B, the center hole 25 and the first bore 410A. A first socket 442 is defined by an inner threaded wall of the sleeve 44. A first bolt 43 is mounted in the upper portion 402A of the first casing 40A and is threadedly fitted in the first socket 442 such that the supporting plate 20 can be pivoted relative to the first and second casings 40A and 40B.

The vertical section 32 of the base 30 has a center hole 33 de-fined therein. A third stub 42A extends from an inner wall of the lower portion 404A of the first casing 40A and abuts on the first side of the vertical section 32 of the base 30. A third bore 420A is defined in the third stub 42A and aligns with the center hole 33.

A fourth stub 42B extends from an inner wall of the lower portion 404B of the second casing 40B and abuts on the second side of the vertical section 32 of the base 30. A fourth bore 420B is defined in the fourth stub 42B and aligns with the center hole 33.

A second sleeve 440 is mounted on the lower portion 404B of the second casing 40B and extends through the fourth bore 420B, the center hole 33 and the third bore 420A. A second socket 441 is defined by an inner threaded wall of the second sleeve 440. A second bolt 430 is mounted on the lower portion 404A of the first casing 40A and is threadedly fitted in the second socket 441 such that the first and second casings 40A and 40B can be pivoted relative to the vertical section 32 of the base 30.

The supporting plate 20 has a plurality of first spaced holes 26 defined therein and arranged around the center hole 25 in a semi-circular manner. A plurality of first spaced numerals 27 are printed on the supporting plate and are each arranged between each of the first spaced holes 26 and the center hole 25 in a semi-circular manner.

A first viewing hole 47 is defined in the upper portion 402B of the second casing 40B and aligns with a corresponding one of the first spaced numerals 27.

A cavity 45 is defined in the inner wall of the upper portion 402A of the first casing 40A.

The first snapping mechanism 50A includes a first pin 52A mounted between the supporting plate 20 and the inner wall of the upper portion 402A of the first casing 40A and having a first end 522A detachably received in a corresponding one of the plurality of first spaced holes 26 and a second end 524A extending through the cavity 45. A first flange 526A is formed near the first end 522A of the first pin 52A and abuts on the supporting plate An upper knob 56A is fixedly mounted on the second end 524A of the pin 52A and abuts on the upper portion 402A of the first casing 40A. A first biasing member 54A is mounted between the first flange 526A and the inner wall of the upper portion 402A of the first casing 40A.

The vertical section 32 of the base 30 has a plurality of second spaced holes 34 defined therein and arranged around the center hole 33 in a semi-circular manner. A plurality of second spaced numerals 35 are printed on the vertical section 32 of the base 30 and are each arranged between each of the second spaced holes 34 and the center hole 33 in a semi-circular manner.

A second viewing hole 470 is defined in the lower portion 404B of the second casing 40B and aligns with a corresponding one of the second spaced numerals 35.

A cavity 46 is defined in the inner wall of the lower portion 404A of the first casing 40A.

The second snapping mechanism 50B includes a second pin 52B mounted between the vertical section 32 of the base 30 and the inner wall of the lower portion 404A of the first casing 40A and having a first end 522B detachably received in a corresponding one of the plurality of second spaced holes 34 and a second end 524B extending through the cavity 46. A second flange 526B is formed near the first end 522B of the second pin 52B and abuts on the vertical section 32 of the base 30.

A lower knob 56B is fixedly mounted on the second end 524B of the second pin 52B and abuts on the lower portion 404A of the first casing 40A. A second biasing member 54B is mounted between the second flange 526B and the inner wall of the lower portion 404A of the first casing 40A.

Figure 5:
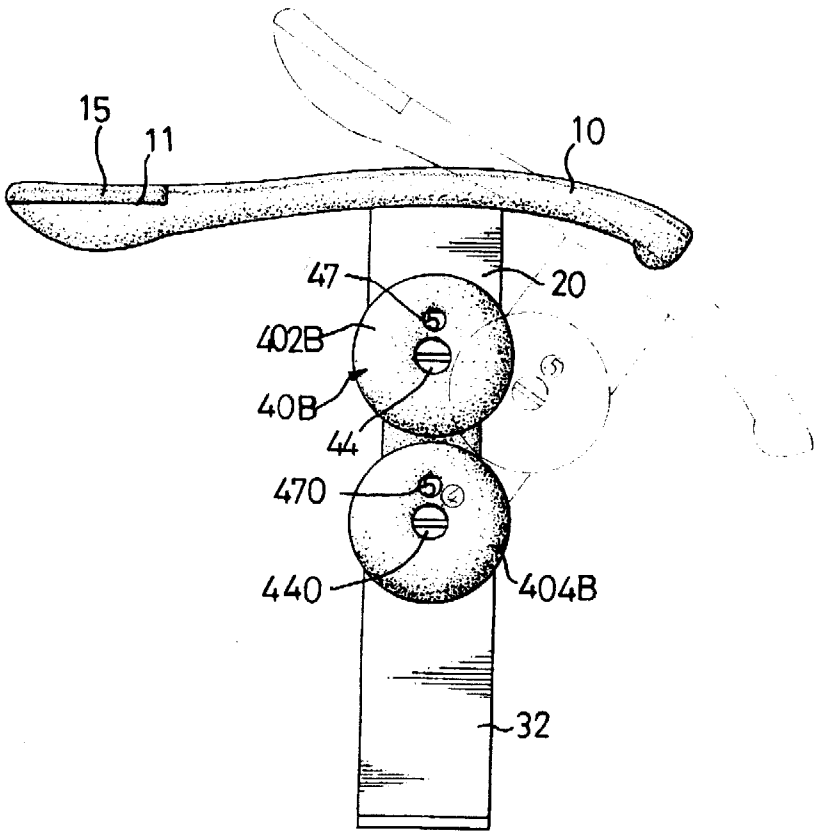
FIGS. 5 and 6 are operational views of FIG. 2.
Figure 6:
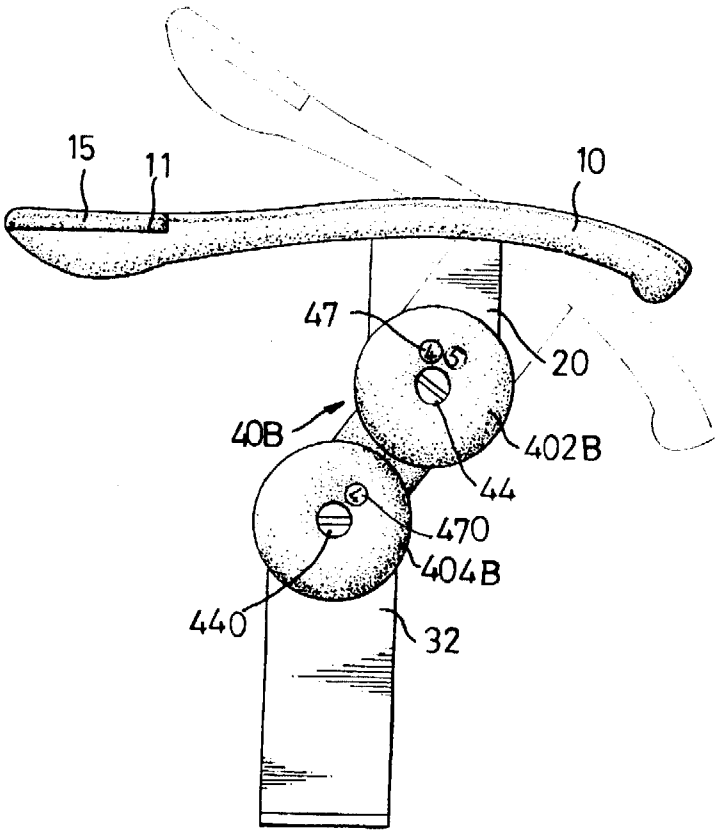

In operation, referring to FIGS. 5 and 6 with reference to FIGS. 3 and 4, the first end 522A of the first pin 52A is initially received in one of the plurality of first spaced holes 26 by means of the biasing member 54A, thereby fixing the supporting plate 20 on the first and second casings 40A and 40B, and the first end 522B of the second pin 52B is received in one of the plurality of second spaced holes 34 by means of the second biasing member 54B, thereby fixing the first and second casings 40A and 40B on the vertical section 32 of the base 30.

The lower knob 56B can be pulled outwardly relative to the lower portion 404A of the first casing 40A, thereby detaching the first end 522B of the second pin 52B from the associated second hole 34 while the first end 522A of the first pin 52A is still received in the associated first hole 26 such that the supporting plate 20 together with the first and second casings 40A and 40B can be pivoted relative to the vertical section 32 of the base 30 from a position as shown in solid lines to a position as shown in phantom lines in FIG. 5 until the first end 522B of the second pin 52B is again received in another adjacent second hole 34 by means of a returning action of the biasing member 54B.

Afterwards, the upper knob 56A can be pulled outwardly relative to the upper portion 402A of the first casing 40A, thereby detaching the first end 522A of the first pin 52A from the associated first hole 26 while the first end 522B of the second pin 52B is still received in the associated second hole 34 such that the supporting plate 20 together with the armrest 10 can be pivoted backwards relative to the first and second casings 40A and 40B from a position as shown in phantom lines to a position as shown in solid lines in FIG. 6 until the first end 522A of the first pin 52A is again received in an adjacent first hole 26 by means of a returning action of the biasing member 54A.

Accordingly, by such an arrangement, the inclined angle of the armrest 10 can be adjusted arbitrarily as shown in FIG. 5. In addition, the height of the armrest 10 can also be adjusted freely as shown in FIG. 6.

It should be clear to those skilled in the art that further embodiments of the present invention may be made without departing from the scope and spirit of the present invention.

What is claimed is:

1. An armrest adjusting device in combination with a chair having a seat, comprising:

a substantially L-shaped base having a horizontal section fixedly attached to each of two sides of the seat, and a vertical section;

a cover having a lower portion pivotally mounted on the vertical section of said base, and an upper portion, said cover including a first casing having a first upper portion with a first stub defining a first bore, and a first lower portion mounted on a first side of the vertical section of said base, a second casing having a second upper portion with a second stub defining a second bore, and a second lower portion mounted on a second side of the vertical section of said base, and wherein a cavity is formed in the first upper portion and above said first stub;

a supporting plate pivotally mounted on an upper portion of said cover and having a center hole, a plurality of spaced holes arranged around said center hole, a first side abutting on said first stub, and a second side abutting on said second stub;

a sleeve mounted on the second upper portion and extending through said second bore, said center hole and said first bore;

a socket defined by an inner threaded wall of said sleeve;

a bolt mounted on the first upper portion and threadedly fitted in said socket;

an armrest fixedly mounted on an upper portion of said supporting plate;

a first snapping mechanism mounted on the upper portion of said cover and detachably engaged with said supporting plate, for limiting a pivotal movement of said supporting plate relative to the upper portion of said cover, said first snapping mechanism including a pin mounted between said supporting plate and the first upper portion, and having a first end detachably received in one of said spaced holes, and a second end extending through said cavity, a flange formed on the first end of said pin and abutting on said supporting plate, a knob fixedly mounted on the second end of said pin and abutting on the first upper portion, and a biasing member mounted between said flange and the first upper portion; and a second snapping mechanism mounted on the lower portion of said cover and detachably engaged with the vertical section of said base, for limiting a pivotal movement of the lower portion of said cover relative to the vertical section of said base.

2. The armrest adjusting device in accordance with claim 1, wherein the vertical section of said base comprises:

a second center hole;

a third stub extending from the first lower portion and abutting on the first side of the vertical section of said base;

a third bore defined in said third stub and aligning with said second center hole;

a fourth stub extending from the second lower portion and abutting on the second side of the vertical section of said base;

a fourth bore defined in said fourth stub and aligning with said second center hole;

a second sleeve mounted on the second lower portion and extending through said fourth bore, said second center hole, and said third bore;

a second socket defined by an inner threaded wall of said second sleeve; and a second bolt mounted on the first lower portion and threadedly fitted in said second socket.

3. The armrest adjusting device in accordance with claim 2, wherein:

the vertical section of said base includes a plurality of second spaced holes arranged around said second center hole;

a second cavity is formed in the first lower portion; and said second snapping mechanism includes a second pin mounted between the vertical section of said base and the first lower portion and having a first end detachably received in one of said second spaced holes, and a second end extending through said second cavity, a second flange formed on the first end of said second pin and abutting on the vertical section of said base, a second knob fixedly mounted on the second end of said second pin and abutting on the first lower portion, and a second biasing member mounted between said second flange and the first lower portion.

4. An armrest adjusting device in combination with a chair having a seat, comprising:

a substantially L-shaped base having a horizontal section fixedly attached to each of two sides of the seat, and a vertical section;

a cover having a lower portion pivotally mounted on the vertical section of said base, and an upper portion, said cover including a first casing having a first upper portion with a first stub defining a first bore, and a first lower portion mounted on a first side of the vertical section of said base, and a second casing having a second upper portion with a second stub defining a second base, and a second lower portion mounted on a second side of the vertical section of said base;

a supporting plate pivotally mounted on an upper portion of said cover;

an armrest fixedly mounted on an upper portion of said supporting plate;

a first snapping mechanism mounted on the upper portion of said cover and detachably engaged with said supporting plate, for limiting a pivotal movement of said supporting plate relative to the upper portion of said cover;

a second snapping mechanism mounted on the lower portion of said cover and detachably engaged with the vertical section of said base for limiting a pivotal movement of the lower portion of said cover relative to the vertical section of said base, wherein the vertical section of said base comprises a center hole, a first stub extending from the first lower portion and abutting on the first side of the vertical section of said base, a first bore defined in said first stub and aligning with said center hole, a second stub extending from the second lower portion and abutting on the second side of the vertical section of said base, a second bore defined in said second stub and aligning with said center hole, a sleeve mounted on the second lower portion and extending through said second bore, said center hole, and said first bore, and a socket defined by an inner threaded wall of said sleeve;

a bolt mounted on the first lower portion and threadedly fitted in said socket; the vertical section of said base includes a plurality of spaced holes arranged around said center hole, and a cavity is formed in the first lower portion, and said second snapping mechanism includes a pin mounted between the vertical section of said base and the first lower portion and having a first end detachably received in one of said spaced holes, and a second end extending through said cavity, a flange formed on the first end of said pin and abutting on the vertical section of said base, a knob fixedly mounted on the second end of said pin and abutting on the first lower portion, and a biasing member mounted between said flange and the first lower portion.

* * * * *